US009774099B2

(12) United States Patent
Aoki et al.

(10) Patent No.: US 9,774,099 B2
(45) Date of Patent: Sep. 26, 2017

(54) STRUCTURE FOR CONNECTING CRIMPING TERMINAL AND ELECTRIC WIRE

(71) Applicant: YAZAKI CORPORATION, Tokyo (JP)

(72) Inventors: Hiroshi Aoki, Shizuoka (JP); Kazuto Ohtaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/266,076

(22) Filed: Sep. 15, 2016

(65) Prior Publication Data

US 2017/0005417 A1 Jan. 5, 2017

Related U.S. Application Data

(63) Continuation of application No. PCT/JP2015/060287, filed on Mar. 31, 2015.

(30) Foreign Application Priority Data

Apr. 4, 2014 (JP) ..... 2014-077835

(51) Int. Cl.
*H01R 4/18* (2006.01)
*H01R 13/52* (2006.01)
(Continued)

(52) U.S. Cl.
CPC ..... *H01R 4/185* (2013.01); *H01R 4/62* (2013.01); *H01R 4/70* (2013.01); *H01R 13/52* (2013.01); *H01R 4/188* (2013.01)

(58) Field of Classification Search
CPC ..... H01R 4/184; H01R 4/185; H01R 4/188; H01R 4/20; H01R 4/203; H01R 4/206
See application file for complete search history.

(56) References Cited

U.S. PATENT DOCUMENTS 5,157,853 A * 10/1992 Piana ..... G09F 3/06 40/316
8,607,449 B2 * 12/2013 Kitagawa ..... H01R 4/185 174/110 R
(Continued)

FOREIGN PATENT DOCUMENTS

JP 3-121661 U 12/1991
JP 2010-61906 A 3/2010
(Continued)

OTHER PUBLICATIONS

International Search Report and Written Opinion of the International Search Report for PCT/JP2015/060287 dated Jun. 30, 2015.
(Continued)

*Primary Examiner* — Ross Gushi
(74) *Attorney, Agent, or Firm* — Kenealy Vaidya LLP

(57) ABSTRACT

A structure for connecting a crimping terminal and an electric wire, includes: the crimping terminal that is provided with an electric wire connection section to be crimped to the electric wire, the electric wire connection section including a conductor crimping section and a sheath crimping section which are successively disposed to each other; a waterproof material that includes an opening for allowing the conductor and the conductor crimping section to make contact with each other, has a size to surround the conductor and the sheath which are to be crimped, and is installed between the electric wire connection section and the electric wire; and a recess that is formed on at least one of the electric wire connection section and the sheath, and a bulged and deformed section of the waterproof material deformed by the electric wire connection section which is caulked and crimped enters.

3 Claims, 6 Drawing Sheets

(51) Int. Cl.
*H01R 4/62* (2006.01)
*H01R 4/70* (2006.01)

(56) References Cited

U.S. PATENT DOCUMENTS 8,641,461 B2 * 2/2014 Mitose ..... H01R 4/185 439/587
8,771,015 B2 * 7/2014 Inoue ..... H01R 4/70 439/604
8,834,213 B2 * 9/2014 Sato ..... H01R 4/185 439/866
8,900,010 B2 * 12/2014 Aoki ..... H01R 4/185 439/587
9,033,751 B2 * 5/2015 Sato ..... H01R 4/188 439/877
9,147,944 B2 * 9/2015 Aizawa ..... H01R 4/185
9,172,151 B2 * 10/2015 Sato ..... H01R 4/206
9,293,838 B2 * 3/2016 Sakaguchi ..... H01R 4/62
9,318,815 B2 * 4/2016 Mitose ..... H01R 4/183
9,350,109 B2 * 5/2016 Ohnuma ..... H01R 4/184
9,509,085 B2 * 11/2016 Morikawa ..... H01R 4/62
2002/0027013 A1 * 3/2002 Kondo ..... H01R 4/70 174/110 R
2005/0095892 A1 * 5/2005 Fukuyama ..... H01R 11/12 439/287
2005/0227549 A1 * 10/2005 Takayama ..... H01R 4/185 439/851
2005/0227550 A1 * 10/2005 Takayama ..... H01R 4/185 439/851
2012/0329342 A1 * 12/2012 Sato ..... H01R 4/184 439/866
2012/0329343 A1 * 12/2012 Sato ..... H01R 4/185 439/866
2013/0005197 A1 * 1/2013 Sato ..... H01R 4/188 439/741
2013/0130569 A1 * 5/2013 Sato ..... H01R 4/206 439/882
2013/0292173 A1 * 11/2013 Inoue ..... H01R 4/185 174/74 R
2014/0151083 A1 * 6/2014 Ohnuma ..... H01R 4/184 174/93
2014/0224536 A1 * 8/2014 Ito ..... H01R 4/184 174/84 C
2014/0378009 A1 * 12/2014 Yamada ..... H01R 4/187 439/865
2015/0011116 A1 * 1/2015 Ohnuma ..... H01R 4/185 439/519
2015/0011117 A1 * 1/2015 Ohnuma ..... H01R 4/185 439/520
2015/0017833 A1 * 1/2015 Sato ..... H01R 4/184 439/519
2015/0020384 A1 * 1/2015 Yamamoto ..... H01R 4/185 29/863
2015/0021090 A1 * 1/2015 Mano ..... H01R 4/185 174/72 A
2015/0140202 A1 * 5/2015 Sato ..... H01R 4/185 427/58
2015/0140856 A1 * 5/2015 Sato ..... H01R 4/70 439/523
2015/0140874 A1 * 5/2015 Sakaguchi ..... H01R 4/62 439/879
2015/0244133 A1 * 8/2015 Hanazaki ..... H01R 4/184 174/74 R
2015/0287496 A1 * 10/2015 Sato ..... H01R 4/62 174/74 R
2015/0318654 A1 * 11/2015 Kawamura ..... H01R 43/048 439/877
2015/0357722 A1 * 12/2015 Sato ..... H01R 13/5216 439/877
2016/0006164 A1 * 1/2016 Sato ..... H01R 4/185 439/587
2016/0352033 A1 * 12/2016 Sachs ..... H01R 4/188
2016/0359245 A1 * 12/2016 Aoki ..... H01R 4/185
2017/0005417 A1 * 1/2017 Aoki ..... H01R 4/62

FOREIGN PATENT DOCUMENTS

JP 2011-243328 A 12/2011
JP 2012-69449 A 4/2012
JP 2012-198998 A 10/2012
JP 2013-218815 * 10/2013 ..... H01R 43/048

OTHER PUBLICATIONS

International Preliminary Report on Patentability and English language Written Opinion of the International Search Report for PCT/JP2015/060287 dated Oct. 4, 2016.

* cited by examiner

STRUCTURE FOR CONNECTING CRIMPING TERMINAL AND ELECTRIC WIRE

CROSS REFERENCE TO RELATED APPLICATIONS

This application is a continuation of PCT application No. PCT/JP15/060287, which was filed on Mar. 31, 2015 base on Japanese Patent Application (No. 2014-077835) filed on Apr. 4, 2014, the contents of which are incorporated herein by reference.

BACKGROUND OF THE INVENTION

1. Field of the Invention

The present invention relates to a structure for connecting a crimping terminal and an electric wire.

2. Description of the Related Art

A reduction in weight of a vehicle exerts significant influence on fuel efficiency. At the present time, when carbon dioxide emission is required to be reduced, particularly, in electric vehicles or hybrid vehicles in which a wire harness is used more than gasoline vehicles, it is convenient that an electric wire made of aluminum or aluminum alloy of lightweight material is used for the wire harness. However, if water is interposed to contact sections of both of the electric wire and a terminal in a state in which the electric wire made of aluminum, which is formed of aluminum or aluminum alloy, is crimped and connected to the terminal made of copper, which is formed of copper or copper alloy, the water becomes an electrolytic solution between dissimilar metals. If the dissimilar metals such as a copper terminal and an aluminum conductor become electric circuits through an electrolytic solution, because of a difference between corrosion potentials of both of them, corrosion of a metal of a lower potential (for example, aluminum conductor) is prompted. That is, galvanic corrosion is generated.

Here, a crimping terminal is proposed, which is capable of preventing electrolytic corrosion while securing conductivity, even when an electric wire conductor to be crimped by barrel pieces is made of a dissimilar metal (refer to below described PTL 1).

A female crimping terminal (crimping terminal) 501 illustrated in FIG. 6 includes barrel pieces 507 constituting a crimping section 505 which surrounds and crimps an exposed part of an aluminum core wire 503 in both sides of a width direction. The barrel pieces 507 are made of a dissimilar metal (for example, copper) which has different conductivity from that of the aluminum core wire 503. An insulation coating section 511 (water stop sheet, or the like) is included in a surrounding surface 509 of the crimping section 505. The insulation coating section 511 is formed longer than a length of the exposed part of the aluminum core wire 503. The female crimping terminal 501 is crimped by the barrel pieces 507, so that the crimping section 505 surrounds integrally from a tip side further than a tip of the aluminum core wire 503 to a sheath part of a tip side of a sheathed electric wire 513. Accordingly, the insulation coating section 511 or the water stop sheet which is a waterproof material is interposed and seals between the aluminum core wire 503 and the crimping section 505, and therefore, infiltration of water is prevented and galvanic corrosion is prevented from being generated.

PTL 1 is JP-A-2012-69449 (see FIG. 7,Paragraph 0113).

SUMMARY OF THE INVENTION

However, for the female crimping terminal 501 described above, a caulking die is used in a press machine in order to secure electrical and mechanical performance by means of electric wire crimping. If the female crimping terminal 501 compresses the aluminum core wire 503 using the caulking die and crimps and holds aluminum core wire by the crimping section 505, the insulation coating section 511 or the water stop sheet is also pressed at the same time. Particularly, when the water stop sheet is compressed by pressure, the water stop sheet is extruded from the crimping section 505 to the outside. In this case, if the water stop sheet is excessively extruded, there is a concern that the water stop sheet is not present in a position where the water is required to be stopped, and waterproof performance cannot be obtained. As the position where the water is required to be stopped, for example, a superimposing section in which the barrel pieces constituting the crimping section 505 are in contact with each other, or the like is exemplified.

The invention is made under consideration of the conditions described above, and an object thereof is to provide a structure for connecting a crimping terminal and an electric wire which is capable of sufficiently exerting waterproof performance by a waterproof material.

The object described above according to the invention is achieved by configurations as follows.

(1) A structure for connecting a crimping terminal and an electric wire including the crimping terminal that is provided with an electric wire connection section to be crimped to the electric wire, the electric wire connection section including a conductor crimping section which crimps a conductor of the electric wire and a sheath crimping section which crimps the electric wire from an outer circumference of a sheath, which are successively disposed to each other; a waterproof material that includes an opening for allowing the conductor and the conductor crimping section to make contact with each other, has a size to surround the conductor and the sheath which are to be crimped, and is installed between the electric wire connection section and the electric wire; and a recess that is formed on at least one of the electric wire connection section and the sheath, and a bulged and deformed section of the waterproof material deformed by the electric wire connection section which is caulked and crimped enters.

According to the structure for connecting a crimping terminal and an electric wire of a configuration of (1), in the electric wire connection section in which the conductor and the sheath are disposed on the inside thereof through the waterproof material, the conductor crimping section and the sheath crimping section are caulked in respective caulking degrees.

The electric wire connection section is plastic-deformed itself by being caulked at the time of crimping the terminal, and the conductor and the sheath of the electric wire are also plastic-deformed through the waterproof material such as the water stop sheet, or the like. The waterproof material which deforms the conductor and the sheath by caulking the electric wire connection section receives a reaction force from the conductor and the sheath. The waterproof material which receives the reaction force is compressed, and is moved to a surplus space or the like of an inside of the caulked electric wire connection section.

Here, the waterproof material is moved in a direction to be extruded outward by pressure from the inside of the electric wire connection section. At this time, in the waterproof material, the bulged and deformed section, which is compressed and deformed, enters the recess which is formed on a waterproof material facing surface of at least one of the electric wire connection section and the sheath. Protrusion of the waterproof material to the outside, in which the bulged and deformed section enters the recess, is suppressed when the bulged and deformed section is caught in the recesses.

The deformed waterproof material is disposed with high density without a gap on the inside of the electric wire connection section caulked at the time of crimping the terminal. As a result, water is less likely to infiltrate to the inside of the electric wire connection section from the outside. Accordingly, an electrolytic solution is not supplied between dissimilar metals. Accordingly, galvanic corrosion, which is to be generated in, for example, the electric wire made of aluminum or aluminum alloy crimped to the conductor crimping section made of copper or copper alloy, is suppressed.

(2) In the structure for connecting the crimping terminal and the electric wire according to the configuration of (1), the electric wire connection section includes a pair of caulking pieces which are formed in a U-shaped sectional surface and on an inside of which the electric wire is disposed and crimped, and the recess is formed at least on an inside of a tip section of one caulking piece which is superimposed on and is caulked with an outside of a tip section of the other caulking piece.

According to the structure for connecting the crimping terminal and the electric wire of the configuration of (2), in the electric wire connection section of the caulked U-shaped sectional surface, since a pair of the caulking pieces are superimposed with each other, a tip section of one caulking piece which is superimposed becomes a lower side, and a tip section of the other caulking piece becomes an upper side. That is, in the electric wire connection section, which crimps the electric wire, the inside of the tip section of the other caulking piece is superimposed on and is caulked with the outside of the tip section of one caulking piece. The waterproof material provided on the waterproof material facing a surface which is the inside of the electric wire connection section, is pinched between the outside of the tip section of one caulking piece and the inside of the tip section of the other caulking piece. The waterproof material, which is disposed between the outside of the tip section of one caulking piece and the inside of the tip section of the other caulking piece, is moved in a direction to be extruded outward by pressure from the inside of the caulked electric wire connection section. At this time, protrusion of the waterproof material to the outside is suppressed by the bulged and deformed section entering and remaining at the recess, which is recessed and provided on the inside of the tip section of the other caulking piece. Accordingly, after caulking, a space between the outside of the tip section of one caulking piece and the inside of the tip section of the other caulking piece is reliably watertight-sealed with the waterproof material, and the water is less likely to infiltrate to the inside of the electric wire connection section from a joint.

(3) In the structure for connecting the crimping terminal and the electric wire according to the configuration of (1) or (2), the recess is formed at least on a conductor tip side edge section in the electric wire connection section and a sheath crimping side edge section of an opposite side of the conductor tip side edge section.

According to the structure for connecting a crimping terminal and an electric wire of the configuration of (3), the waterproof material which is compressed by being caulked using the electric wire connection section is moved to a conductor tip side and a sheath crimping side along an extending direction of the electric wire in the inside of the electric wire connection section. At this time, protrusion of the waterproof material from the conductor tip side edge section to the outside is suppressed, by the bulged and deformed section entering at the recess formed on the conductor tip side edge section of the electric wire connection section. In addition, protrusion of the waterproof material from the sheath crimping side edge section to the outside is suppressed by the bulged and deformed section entering at the recess formed on the sheath crimping side edge section of the electric wire connection section. As a result, the waterproof material can remain with high density in the inside of the electric wire connection section.

According to the structure for connecting a crimping terminal and an electric wire according to the invention, waterproof performance can be sufficiently exerted by the waterproof material.

Hitherto, the invention has been described briefly. Further, a configuration (hereinafter, referred to as "embodiment") for realizing the invention to be described below is read with reference to attached drawings, and thus details of the invention will be further clarified.

DESCRIPTION OF EMBODIMENT

Hereinafter, an embodiment according to the invention will be described with reference to drawings.

Figure 1:
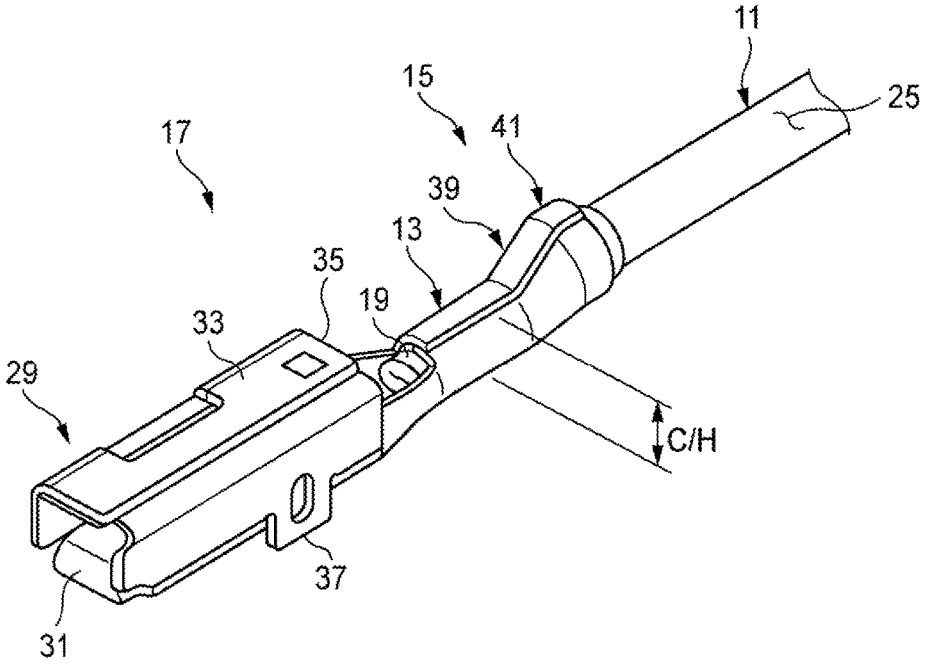
FIG. 1 is a perspective view of a crimping terminal used for a structure for connecting the crimping terminal and an electric wire according to an embodiment of the invention.
Figure 2:
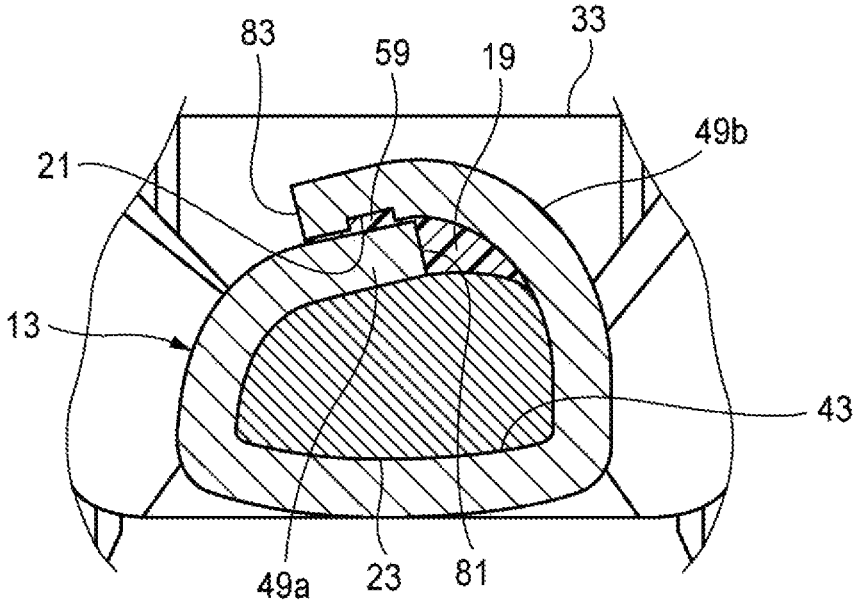
FIG. 2 is a sectional view in a direction orthogonal to an extending direction of an electric wire of a conductor crimping section illustrated in FIG. 1.
Figure 3:
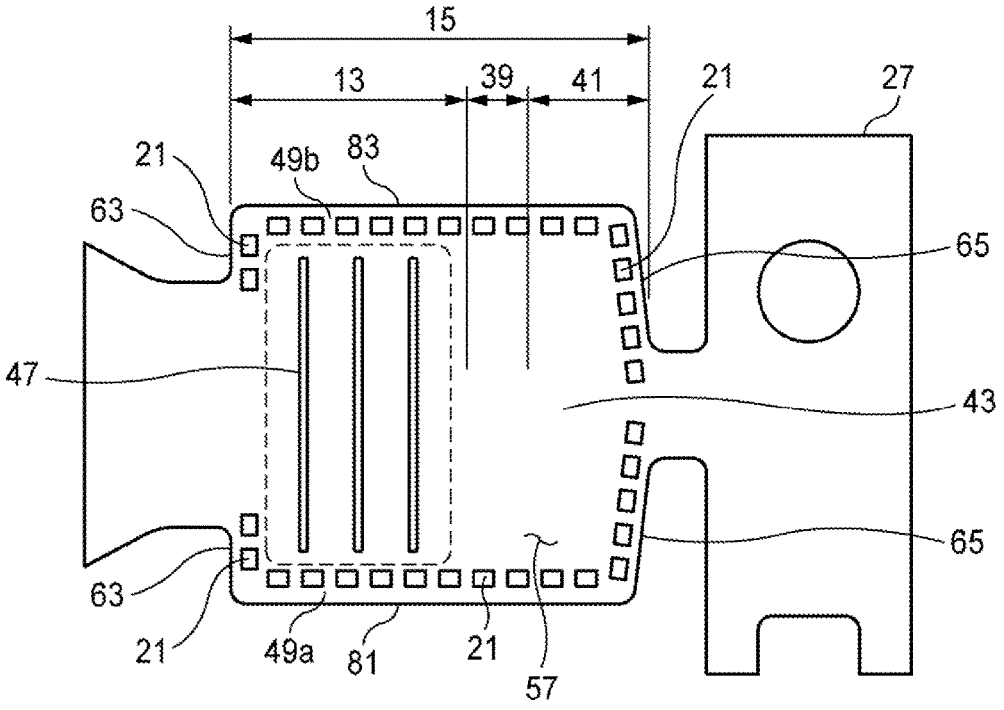
FIG. 3 is a plan view of a deployment shape of an electric wire connection section of the crimping terminal illustrated in FIG. 1.

As illustrated in FIG. 1 to FIG. 3, a structure for connecting a crimping terminal and an electric wire according to an embodiment of the invention is provided with an electric wire 11, a crimping terminal 17, a water stop sheet 19 which is a waterproof material, and recesses 21.

In the electric wire 11, a conductor 23 is covered with an insulating sheath 25. The conductor 23 is constituted by a plurality of stranding element wires. Also, the conductor 23 may be a single line. In the conductor 23, for example, aluminum or aluminum alloy is used. In the sheath 25, synthetic resin is used. As the synthetic resin, for example, resin in which flame retardant is added to polyvinyl chloride (PVC), polyolefin, or polyamide as a base can be used.

The crimping terminal 17 is formed by a press process (punching process and a bending process) from a metal plate of one sheet conductive metal (copper or copper alloy). The crimping terminal 17 is punch-processed in a state in which a carrier 27 is coupled thereto in a chain shape. The crimping terminal 17 is used, for example, by being mounted on a connector housing (not illustrated). An electrical contacting section 29 and an electric wire connection section 15 are successively disposed from each tip side of the crimping terminal 17. The electrical contacting section 29 is electrically connected to a mating terminal. The electric wire connection section 15 is connected to the electric wire 11. In the electrical contacting section 29, a case section 33 including a spring section 31 is formed. The case section 33 accommodates a tab-shaped conductor connecting section of a male terminal (not illustrated) which is a mating terminal, and conducts and connects the spring section 31 and the male terminal. That is, the crimping terminal 17 is a female terminal.

A lance engaging section 35 is formed in the case section 33. The lance engaging section 35 is engaged with a lance (not illustrated) formed in the connector housing from a rear side, when the crimping terminal 17 enters an accommodating chamber of the connector housing. Accordingly, a rear loosening from the accommodating chamber of the crimping terminal 17 is regulated. In addition, a spacer abutting section 37 is provided in the case section 33. In the spacer abutting section 37, if the spacer (not illustrated) is mounted on the connector housing, a secondary engaging section formed in the spacer is abutted.

The electric wire connection section 15 includes a conductor crimping section 13 to be crimped by a conductor exposing section in which the conductor 23, in which the sheath 25 of a terminal section of the electric wire 11 is removed, is exposed, in a front side position thereof. The electric wire connection section 15 includes a sheath crimping section 41 which is crimped to the sheath 25 of the terminal section of the electric wire 11 through a joint section 39, in a rear side position thereof. The joint section 39 connects a rear side of the conductor crimping section 13 and a front side of the sheath crimping section 41. The conductor crimping section 13 and the sheath crimping section 41 are formed in a size in accordance with a diameter of the conductor 23 or a diameter of the sheath 25.

As illustrated in FIG. 3, the conductor crimping section 13, the joint section 39, and the sheath crimping section 41 have a common bottom plate section 43. A groove-shaped serration 47 for conductor is formed on in the bottom plate section 43 of the conductor crimping section 13. The bottom plate section 43 of the electric wire connection section 15 includes a pair of common right and left caulking pieces 49*a* and 49*b* which is stood upward from both sides of right and left edges. As illustrated in FIG. 2, the caulking pieces 49*a* and 49*b* caulk to surround the conductor 23 and the sheath 25 of the electric wire 11 by being bent inward in a state in which the conductor 23 and the sheath 25 are closely adhered to an upper surface of the bottom plate section 43. The electric wire connection section 15 is continued from a front end of the conductor crimping section 13 to a rear end of the sheath crimping section 41 and is formed on a U-shaped sectional surface illustrated in FIGS. 4A and 4B. The electric wire connection section 15 has a length which continuously integrally covers from a front side further than a conductor front end 51 (refer to FIG. 4B) to a rear side further than a sheath front end 53 (refer to FIG. 4B), in a state of crimping the terminal section of the electric wire 11.

As seen from the above, in the crimping terminal 17, the conductor crimping section 13, which crimps the conductor 23 of the electric wire 11, and the sheath crimping section 41, which crimps the electric wire 11 from the outer circumference of the sheath 25, are successively disposed and caulked so as to be crimped and fixed to the electric wire 11.

The water stop sheet 19 is made of a resin material having a certain thickness and elasticity, and an insulating material such as rubber. The water stop sheet 19 includes the opening 55 allowing the conductor 23 and the conductor crimping section 13 to contact with each other. The opening 55 of the embodiment is formed by punching the water stop sheet 19 in a U-shaped. In addition, the opening 55 may be a hole in which peripheries are closed. The water stop sheet 19 has a size which surrounds the conductor 23 and the sheath 25 to be crimped. The water stop sheet 19 is disposed on the waterproof material facing surface 57 of the electric wire connection section 15 and interposed between the electric wire connection section 15 and the electric wire 11. Accordingly, the water stop sheet 19 is caulked by the electric wire connection section 15 so as to surround and seal the conductor 23 and the sheath 25.

Here, the water stop sheet 19 can be configured with a double-sided adhering sheet in which an adhering layer is provided on both sides of a substrate sheet. Also, a release sheet is provided on each adhering layer of the water stop sheet 19 before being used, through a release layer.

Moreover, the recesses 21 are provided on at least one of the electric wire connection section 15 and the sheath 25. In the embodiment, the recesses 21 are provided on both of the electric wire connection section 15 and the sheath 25. In the recess 21, a bulged and deformed section 59 (refer to FIG. 2) of the water stop sheet 19, which is deformed by the electric wire connection section 15 caulked at the time of crimping a terminal, enters. The recesses 21 can be provided with predetermined intervals as illustrated in FIG. 3. In addition, the recesses 21 may be formed in groove shapes in which arbitrary plurality of recesses are continuous. The recesses 21 can be formed by, for example, a press process using a punch, or the like, or a laser process. It is preferable that edges are provided on peripheries of an opening in the recesses 21. It is because that engaging strength of the bulged and deformed section 59 of the water stop sheet 19, which enters the recess 21, can be increased.

In the electric wire connection section 15, each a core wire contacting section (conductor crimping section 13), a sheath holding section (sheath crimping section 41), or the like, has a different compression ratio so that a sheet extrusion condition is different. For this reason, the recesses 21 is appropriately provided to a position where the sheet extrusion is necessary to be suppressed.

In the electric wire connection section 15 of a caulked U-shaped sectional surface, a pair of the caulking pieces 49*a* and 49*b* are superimposed on each other so as to be crimped. In such a crimping structure, as illustrated in FIG. 2, it is preferable that the recesses 21 are formed on at least the inside (inside of tip section) of the tip section 83 of the caulking piece 49*b* of the other side, which are is superimposed on and is caulked with the outside (outside of tip section) of the tip section 81 of the caulking piece 49*a* of one side.

In addition, as illustrated in FIG. 3, it is preferable that the recesses 21 are formed at least on a conductor tip side edge section 63 in the electric wire connection section 15 and a sheath crimping side edge section 65 on an opposite side of the conductor tip side edge section 63.

Particularly, in order to improve an electrical performance, it is desired that the conductor 23 is compressed by reducing a height C/H after the conductor crimping section 13 illustrated in FIG. 1 is crimped in a structure for connecting the crimping terminal and the electric wire 11. However, according to this, the water stop sheet 19 is likely to be extruded. Meanwhile, in order to stabilize a fixing strength (electric wire holding strength) which is a mechanical performance, it is desired that the height C/H after crimping is set to be high. However, in this case, it is set to be a side where compression of the water stop sheet 19 is not sufficient.

Here, in the structure for connecting the crimping terminal and the electric wire 11 according to the embodiment, a waterproof performance can be stabilized by biting the water stop sheet 19 into edges of the recesses 21. As a result, a setting range of C/H standard can be widened.

Next, a connection sequence of the crimping terminal 17 and the electric wire 11 will be described.

Figure 4A:
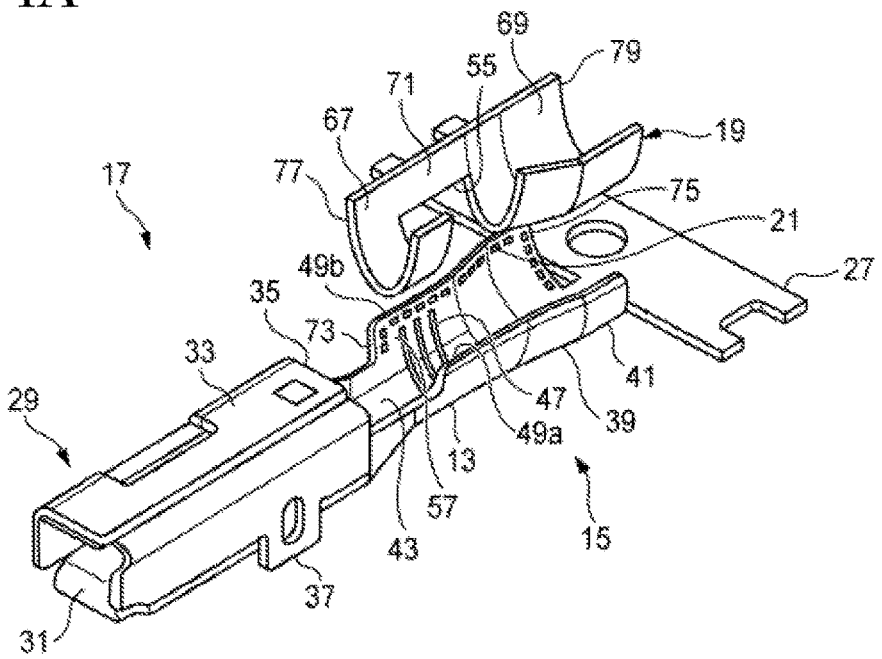
FIG. 4A is an exploded perspective view of a crimping terminal before a waterproof material is assembled.
Figure 4B:
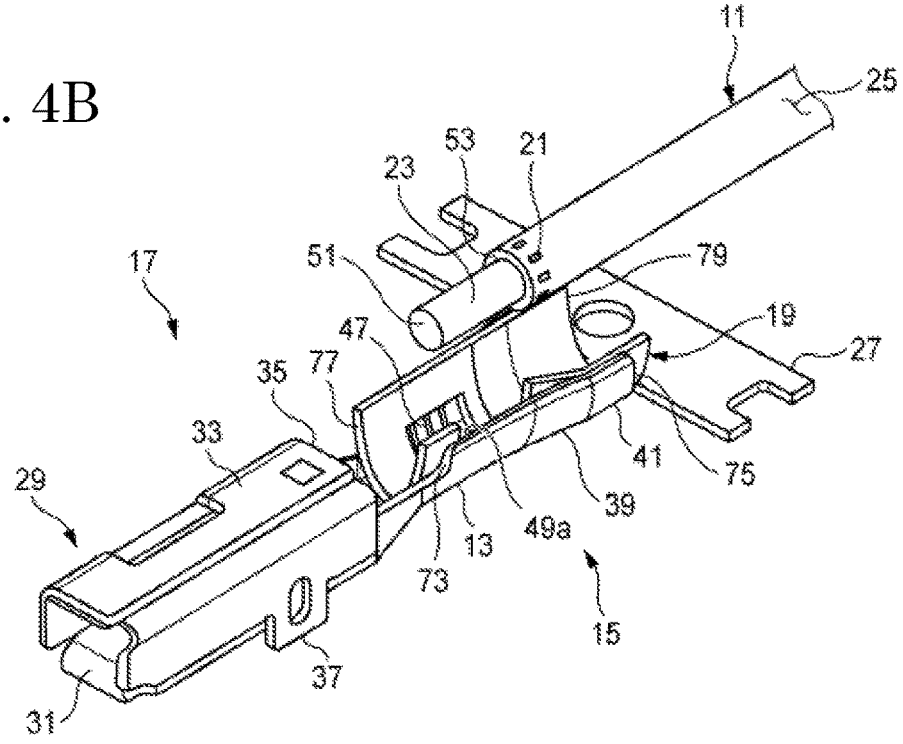
FIG. 4B is an exploded perspective view of the crimping terminal before crimping the electric wire.

First, as illustrated in FIG. 4A, the water stop sheet 19 including the opening 55 is disposed on a position corresponding to the conductor exposing section of an inside surface of the electric wire connection section 15, which is formed on a U-shaped sectional surface of the crimping terminal 17. The water stop sheet 19 includes a front side sheet section 67 extending in a width direction of the electric wire connection section 15 at a position on a front side further than the opening 55, and includes a rear side sheet section 69 extending in a width direction of the electric wire connection section 15 at a position on a rear side further than the opening 55. Further, the water stop sheet 19 includes a side sheet section 71 which connects the front side sheet section 67 and the rear side sheet section 69 at a position of the front side of the opening 55.

In addition, when the electric wire connection section 15 is crimped to the terminal section of the electric wire 11, the water stop sheet 19 is formed in a length where a crimping section front end 73 and a crimping section rear end 75 of the electric wire connection section 15, and the waterproof material front end 77 and the waterproof material rear end 79 of the water stop sheet 19 are protruded to the outside. Specifically, the water stop sheet 19 is formed in a length where the waterproof material front end 77 of the front side sheet section 67 is positioned on a front side further than the crimping section front end 73 of the conductor crimping section 13, and the waterproof material rear end 79 of the rear side sheet section 69 is formed on a rear side further than the crimping section rear end 75 of the sheath crimping section 41. The water stop sheet 19 is attached to the waterproof material facing surface 57 of the electric wire connection section 15 using the adhering layer exposed by releasing the release sheet in one surface of the water stop sheet 19.

When the water stop sheet 19 is disposed on the waterproof material facing surface 57 of the electric wire connection section 15, the release sheet in a surface of the other side of the water stop sheet 19 is released so that the adhering layer is exposed, and then a terminal section of the peeled (sheath 25 is ablated in a predetermined length) electric wire 11 is disposed on an upper surface of the bottom plate section 43 of the electric wire connection section 15. At this time, the conductor front end 51 of the conductor exposing section is disposed on a rear side further than the waterproof material front end 77 of the water stop sheet 19. The sheath front end 53 of the sheath 25 is disposed on a front side further than the waterproof material rear end 79 of the water stop sheet 19, and on a front side further than the crimping section rear end 75 of the electric wire connection section 15.

In this state, the electric wire connection section 15 is crimped to the terminal section of the electric wire 11. That is, the right and left caulking pieces 49*a* and 49*b* are bent and caulked so as to sequentially surround the terminal section of the electric wire 11, and as illustrated in FIG. 2, a tip section 83 of the caulking piece 49*b* of the other side is superimposed on a tip section 81 of the caulking piece 49*a* of one side.

Because of such caulking, the conductor crimping section 13 of the crimping terminal 17 and the conductor 23 of the electric wire 11 are electrically connected to each other through the opening 55 formed on the water stop sheet 19. In addition, a front and rear of a connection part of the conductor crimping section 13 and the conductor 23 are shielded by the water stop sheet 19. In addition, the waterproof material front end 77 and the waterproof material rear end 79 of the water stop sheet 19 are protruded to the outside from the crimping section front end 73 and the crimping section rear end 75 of the electric wire connection section 15, and the structure for connecting of the embodiment of the invention is complete.

Next, action of the structure for connecting the crimping terminal and the electric wire 11 having a configuration described above will be described.

In the structure for connecting the crimping terminal 17 and the electric wire 11 according to the embodiment, the waterproof material becomes, for example, the water stop sheet 19. In addition, the waterproof material may be an insulation coating. The water stop sheet 19 surrounds the conductor 23 and the sheath 25 and is disposed on the electric wire connection section 15. The electric wire connection section 15 is formed, for example, in a U-shaped, and the electric wire 11, which is exposed inward, of the conductor 23 includes a sheath tip and disposed therein.

The conductor 23 and the sheath 25, which are disposed on the electric wire connection section 15, is surrounded by the water stop sheet 19. More specifically, the water stop sheet 19 is formed to be equal to or slightly more than the electric wire connection section 15. The water stop sheet 19 is superimposed on the inside (waterproof material facing surface 57) of the electric wire connection section 15, and further, the conductor 23 and the sheath 25 are disposed therein.

In the electric wire connection section 15 in which the conductor 23 and the sheath 25 are disposed there in through the water stop sheet 19, the conductor crimping section 13 and the sheath crimping section 41 are caulked in respective caulking degrees. At this time, in the electric wire connection section 15, the tip sections 81 and 83 (refer to FIG. 2) of a pair of the caulking pieces 49*a* and 49*b* are superimposed on each other.

The electric wire connection section 15 is plastic-deformed itself by being crimped at the time of crimping a terminal, and the conductor 23 and the sheath 25 of the electric wire 11 are also plastic-deformed through the water stop sheet 19. At this time, the conductor 23 is brought into contact with the conductor crimping section 13 through the opening 55 provided in the water stop sheet 19. This contacting becomes adhesion (bonding at molecular or atomic level), and good conductivity is secured. The water stop sheet 19, which allows the conductor 23 and the sheath 25 to be deformed by caulking of the electric wire connection section 15, receives reaction force from the conductor 23 and the sheath 25. The water stop sheet 19 which receives the reaction force is compressed, and is moved to a surplus space or the like, inside the caulked electric wire connection section 15.

Here, the water stop sheet 19 is moved in a direction where the water stop sheet is protruded outward by pressure from the inside of the electric wire connection section 15. At this time, in the water stop sheet 19, the bulged and deformed section 59, which is compressed and deformed, enters the recess 21 formed on the waterproof material facing surface 57 of the electric wire connection section 15 and the sheath 25. Protrusion of the water stop sheet 19 to the outside by the bulged and deformed section 59 entering at the recess 21, is suppressed when the bulged and deformed section 59 is caught on the recesses 21.

The deformed water stop sheet 19 is disposed with high density without a gap in an inside of the electric wire connection section 15 caulked at the time of crimping the terminal. As a result, water is less likely to infiltrate to the inside of the electric wire connection section 15 from the outside. Accordingly, electrolytic solution is not supplied between dissimilar metals. Accordingly, for example, galvanic corrosion, which is generated in the electric wire 11 made of aluminum or aluminum alloy crimped to the conductor crimping section 13 made of copper or copper alloy, is suppressed.

In addition, in the structure for connecting the crimping terminal 17 and the electric wire 11 of the embodiment, in the electric wire connection section 15 of the caulked U-shaped sectional surface, since a pair of the caulking pieces 49*a* and 49*b* are superimposed on with each other, the tip section 81 of the superimposed caulking piece 49*a* of one side becomes a lower side, and the tip section 83 of the caulking piece 49*b* of the other side becomes an upper side. That is, as illustrated in FIG. 2, in the electric wire connection section 15 crimping the electric wire 11, the inside of the tip section 83 of the caulking piece 49*b* of the other side is superimposed on and is caulked with the outside of the tip section 81 of the caulking piece 49*a* of one side. The water stop sheet 19 provided on the waterproof material facing surface 57, which is an inside of the electric wire connection section 15, is pinched between the outside of the tip section 81 of the caulking piece 49*a* of one side and the inside of the tip section 83 of the caulking piece 49*b* of the other side. The water stop sheet 19, which is disposed between the outside of the tip section 81 of the caulking piece 49*a* of one side and the inside of the tip section 83 of the caulking piece 49*b* of the other side, is moved in a direction to be extruded outward by pressure from the inside of the caulked electric wire connection section 15. At this time, protrusion of the water stop sheet 19 to the outside is suppressed, when the bulged and deformed section 59 enters and remains in the recess 21, which is recessed and provided on the inside of the tip section 83 of the caulking piece 49*b* of the other side (refer to FIG. 2). Accordingly, after caulking, a space between the outside of the tip section 81 of the caulking piece 49*a* of one side and the inside of the tip section 83 of the caulking piece 49*b* of the other side is reliably watertight-sealed with the water stop sheet 19. As a result, in a joint, infiltration of water to the inside of the electric wire connection section 15 is reliably prevented.

In addition, in the structure for connecting the crimping terminal 17 and the electric wire 11 of the embodiment, the water stop sheet 19 compressed by being caulked of the electric wire connection section 15 is moved to the conductor tip side edge section 63 and the sheath crimping side edge section 65 along an extending direction of the electric wire 11 in the inside of the electric wire connection section 15. At this time, protrusion of the water stop sheet 19 to the outside from the conductor tip side edge section 63 by the bulged and deformed section 59 entering at the recess 21, which is formed on the conductor tip side edge section 63 of the electric wire connection section 15, is suppressed. In addition, protrusion of the water stop sheet 19 to the outside from the sheath crimping side edge section 65 by the bulged and deformed section 59 entering to the recess 21, which is formed on the sheath crimping side edge section 65 of the electric wire connection section 15, is suppressed. As a result, the water stop sheet 19 can be remained with high density in the inside of the electric wire connection section 15.

Accordingly, according to structure for connecting the crimping terminal 17 and the electric wire 11 of the embodiment, waterproof performance by the water stop sheet 19 can be sufficiently exerted.

Also, the invention is not limited to the above-described embodiment, and modification, improvement, or the like thereof can be suitably performed. In addition, a material, a shape, a size, a number, a disposing position, or the like of each configuration component in the embodiment described above is arbitrary and is not limited as long as it can achieve the invention.

For example, as the recesses 21 in the embodiment, a recess where the bulged and deformed section of the waterproof material in the invention enters is not limited that the recess is formed on only the inside of the tip section 83 of the caulking piece 49*b* of the other side is superimposed on and is caulked with the outside of the tip section 81 of the caulking piece 49*a* of one side (refer to FIG. 2) .

Figure 5A:
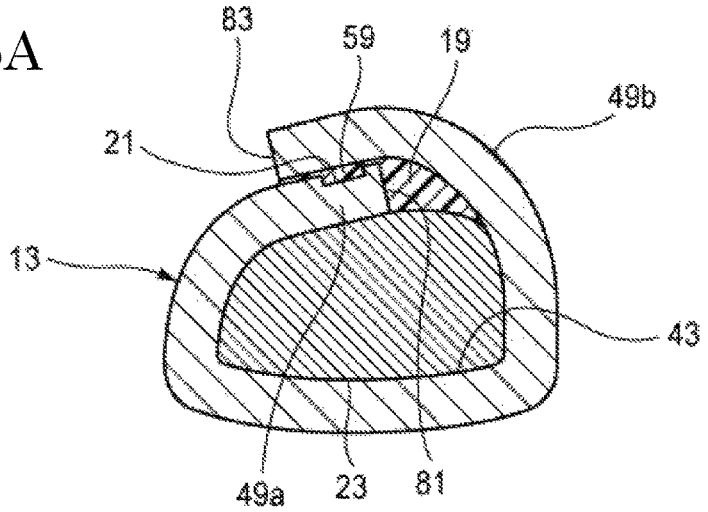
FIGS. 5A to 5C are sectional views illustrating modification examples of the conductor crimping section illustrated in FIG. 2.

As the recesses 21 illustrated in FIG. 5A, the recess may be formed on only the outside of the tip section 81 of the caulking piece 49*a* of one side.

Figure 5B:
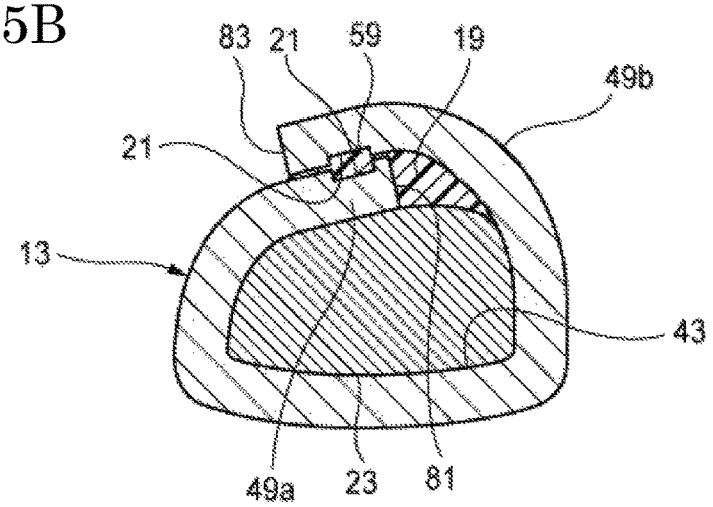

In addition, as a pair of the recesses 21 illustrated in FIG. 5B, the recesses may be formed so as to face with each other, on both of the outside of the tip section 81 of the caulking piece 49*a* of one side and the inside of the tip section 83 of the caulking piece 49*b* of the other side which is superimposed on and is caulked with the outside of the tip section 81.

Figure 5C:
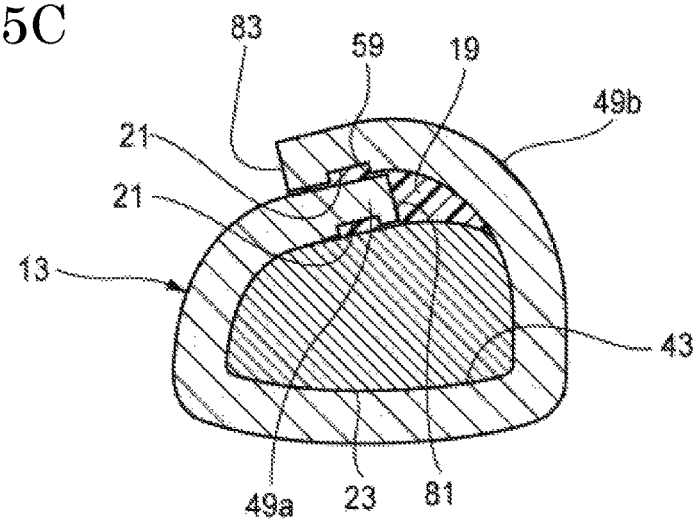
Figure 6:
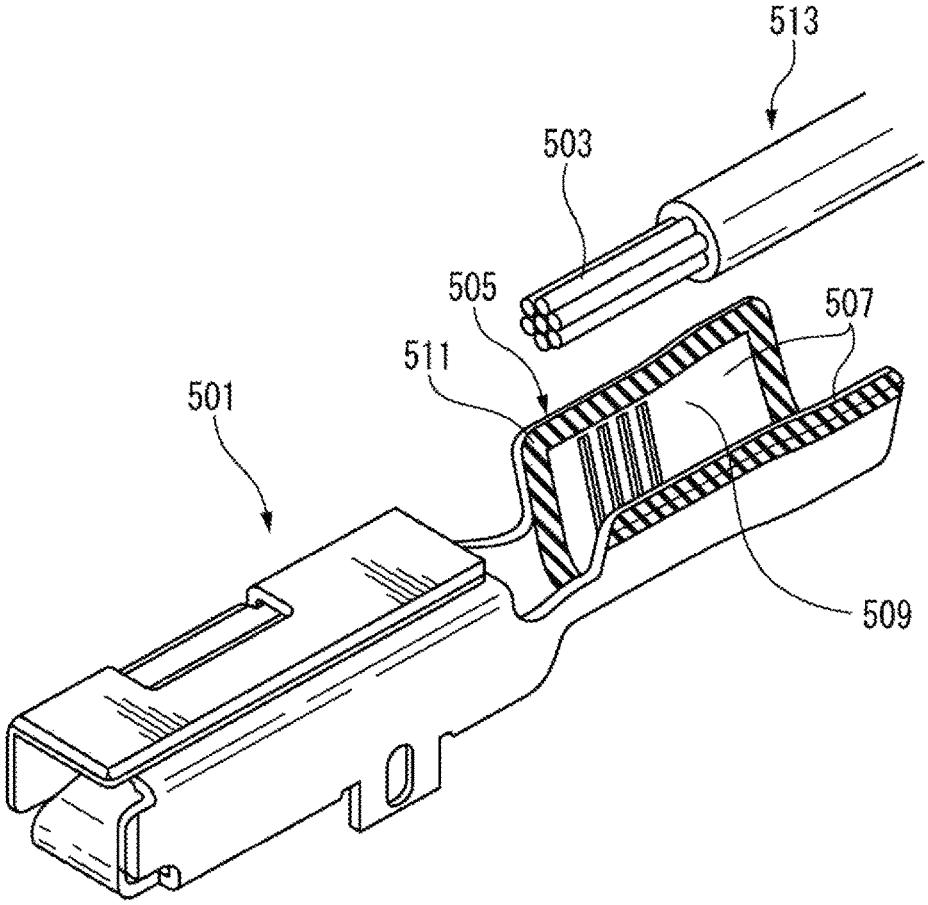
FIG. 6 Related Art
FIG. 6 is a perspective view of the crimping terminal including a waterproof material of the related art.

Further, as a pair of the recesses 21 illustrated in FIG. 5C, the recesses may be formed on both of the inside of the tip section 81 of the superimposed caulking piece 49*a* of one side and the inside of the tip section 83 of the caulking piece 49*b* of the other side which is superimposed on and is caulked with the outside of the tip section 81.

Here, characteristics of the embodiment of the structure for connecting with respect to the electric wire of the crimping terminal according to the invention described above will be briefly summarized and listed respectively as [1] to [3].

The structure for connecting the crimping terminal 17 and the electric wire 11 including: the crimping terminal 17 that is provided with the electric wire connection section 15 to be crimped to the electric wire 11, the electric wire connection section 15 including the conductor crimping section 13 which crimps the conductor 23 of the electric wire 11 and the sheath crimping section 41 which crimps the electric wire 11 from an outer circumference of the sheath 25, which are successively disposed to each other; the waterproof material (water stop sheet) 19 which includes the opening 55 for allowing the conductor 23 and the conductor crimping section 13 to make contact with each other, has a size to surround the conductor 23 and the sheath 25, which are to be crimped, and is installed between the electric wire connection section 15 and the electric wire 11; and the recess

21 which is formed on at least one of the electric wire connection section 15 and the sheath 25, and the bulged and deformed section 59 of the waterproof material (water stop sheet) 19 deformed by the electric wire connection section 15, which is caulked and crimped, enters.

In the structure for connecting the crimping terminal 17 and the electric wire 11 according to the configuration of [1] described above, the electric wire connection section 15 includes a pair of caulking pieces 49*a* and 49*b* which are formed in a U-shaped sectional surface and on an inside of which the electric wire 11 is disposed and crimped, and the recess 21 is formed at least on an inside of a tip section 83 of one caulking piece 49*b* which is superimposed on and is caulked with an outside of a tip section 81 of the other caulking piece 49*a*.

[3] In the structure for connecting the crimping terminal 17 and the electric wire 11 according to the configuration of [1] or [2] described above, the recess 21 is formed at least on a conductor tip side edge section 63 in the electric wire connection section 15 and a sheath crimping side edge section 65 of an opposite side of the conductor tip side edge section 63.

According to the structure for connecting a crimping terminal and an electric wire of the invention, since waterproof performance by the waterproof material can be sufficiently exerted, infiltration of water is prevent and galvanic corrosion can be prevented from being generated. Here, the structure for connecting a crimping terminal and an electric wire of the invention is used for the crimping terminal constituted by a dissimilar metal with respect to the electric wire conductor crimped by the caulking pieces.

What is claimed is:

1. A structure for connecting a crimping terminal and an electric wire, comprising:

the crimping terminal that is provided with an electric wire connection section to be crimped to the electric wire, the electric wire connection section including a conductor crimping section which crimps a conductor of the electric wire and a sheath crimping section which crimps the electric wire from an outer circumference of a sheath, which are successively disposed to each other;

a waterproof material that includes an opening for allowing the conductor and the conductor crimping section to make contact with each other, has a size to surround the conductor and the sheath which are to be crimped, and is installed between the electric wire connection section and the electric wire; and a recess that is formed on at least one of the electric wire connection section and the sheath, and the electric wire connection section and the electric wire apply pressure to the waterproof material when the electric wire connection section crimps and caulks the electric wire such that the waterproof material includes a bulged and deformed section that enters the recess.

2. A structure for connecting a crimping terminal and an electric wire, comprising:

the crimping terminal that is provided with an electric wire connection section to be crimped to the electric wire, the electric wire connection section including a conductor crimping section which crimps a conductor of the electric wire and a sheath crimping section which crimps the electric wire from an outer circumference of a sheath, which are successively disposed to each other;

a waterproof material that includes an opening for allowing the conductor and the conductor crimping section to make contact with each other, has a size to surround the conductor and the sheath which are to be crimped, and is installed between the electric wire connection section and the electric wire; and a recess that is formed on at least one of the electric wire connection section and the sheath, and a bulged and deformed section of the waterproof material deformed by the electric wire connection section which is caulked and crimped enters, wherein the electric wire connection section includes a pair of caulking pieces which are formed in a U-shaped sectional surface and on an inside of which the electric wire is disposed and crimped, and wherein the recess is formed at least on an inside of a tip section of one caulking piece which is superimposed on and is caulked with an outside of a tip section of the other caulking piece.

3. A structure for connecting a crimping terminal and an electric wire, comprising:

the crimping terminal that is provided with an electric wire connection section to be crimped to the electric wire, the electric wire connection section including a conductor crimping section which crimps a conductor of the electric wire and a sheath crimping section which crimps the electric wire from an outer circumference of a sheath, which are successively disposed to each other;

a waterproof material that includes an opening for allowing the conductor and the conductor crimping section to make contact with each other, has a size to surround the conductor and the sheath which are to be crimped, and is installed between the electric wire connection section and the electric wire; and a recess that is formed on at least one of the electric wire connection section and the sheath, and a bulged and deformed section of the waterproof material deformed by the electric wire connection section which is caulked and crimped enters, wherein the recess is formed at least on a conductor tip side edge section in the electric wire connection section and a sheath crimping side edge section of an opposite side of the conductor tip side edge section.

* * * * *